US007171757B1

(12) United States Patent
Stoneberg

(10) Patent No.: US 7,171,757 B1
(45) Date of Patent: Feb. 6, 2007

(54) FOLDING RULER

(75) Inventor: J. Bruce Stoneberg, Oak Brook, IL (US)

(73) Assignee: Learning Resources, Inc., Vernon Hills, IL (US)

( * ) Notice: Subject to any disclaimer, the term of this patent is extended or adjusted under 35 U.S.C. 154(b) by 0 days.

(21) Appl. No.: 11/111,637

(22) Filed: Apr. 21, 2005

(51) Int. Cl.
*B43L 7/00* (2006.01)

(52) U.S. Cl. ..... 33/458; 33/465

(58) Field of Classification Search ..... 33/458, 33/484, 465
See application file for complete search history.

(56) References Cited

U.S. PATENT DOCUMENTS 1,120,443 A * 12/1914 Buck ..... 33/458
1,210,370 A * 12/1916 Dvorak ..... 33/465
1,979,567 A * 11/1934 Nicholson ..... 33/458
4,203,227 A * 5/1980 Giroux ..... 33/458
5,471,749 A * 12/1995 Brady ..... 33/484

FOREIGN PATENT DOCUMENTS

GB 2250959 A * 6/1992

* cited by examiner

*Primary Examiner*—Christopher W. Fulton
(74) *Attorney, Agent, or Firm*—Gardner Carton & Douglas LLP

(57) ABSTRACT

A folding ruler is provided. One embodiment of the folding ruler includes a first panel, a second panel, a hinge and a stiffening member. The first and second panels are interconnected end to end by the hinge so that the ruler can move between a folded state wherein the first and second panels are generally parallel and overlapping, and an unfolded state wherein the first and second panels are coplanar and oriented end to end. The stiffening member couples with the first and second panels to lock the first and second panels in the unfolded state. In some embodiments the stiffening member provides a grip for holding the ruler.

19 Claims, 4 Drawing Sheets

FOLDING RULER

FIELD OF THE INVENTION

This invention generally pertains to a measuring device, and more particularly to straightedge-type devices.

BACKGROUND OF THE INVENTION

Measuring devices are well-known in the art. Straightedges are one type of measuring device that are commonly used for drawing lines and measuring linear distances. Straightedges typically have one or more graduated scales that provide for measurements in one or more units such as the English system (e.g. inches) and the metric system (e.g., centimeters). To this end, such straightedges are commonly available as rulers, yardsticks, metersticks, tape measures and the like.

Straightedges such as yardsticks and metersticks are difficult to transport and store due to their extended lengths. Further, such straightedges may be cumbersome to handle and/or hold in some instances due to their extended-length. In particular, extended-length straightedges are difficult to use on a vertical surface such as a wall. For example, an educator measuring and/or drawing on a vertical board is presented with the challenge of holding and stabilizing the straightedge with only one hand while simultaneously drawing with the other hand. Therefore, in view of the foregoing, a new measuring device that is easy to transport, store and handle would be welcomed.

BRIEF SUMMARY OF THE INVENTION

One embodiment of the invention provides a folding ruler. The folding ruler includes a first panel, a second panel and a stiffening member. The first and second panels are moved between a first state wherein the first and second panels are coupled together, coplanar and oriented end to end, and a second state wherein the first and second panels are uncoupled and may be oriented and stored as desired, for example in a generally parallel and overlapping fashion. Some embodiments may include a hinge that is mechanically affixed to or unitarily formed with the first and second panels, interconnecting the first and second panels end to end for relative movement of the panels between the first and second states. The stiffening member couples with the first and second panels in the first state to lock the first and second panels in the first state. In some embodiments the stiffening member provides a grip for holding the ruler.

BRIEF DESCRIPTION OF THE DRAWINGS

FIG. 4 is a partial plan view of the embodiment of FIG. 1 illustrating an example assembly method therefore; and.

DETAILED DESCRIPTION OF THE EMBODIMENTS

Figure 1:
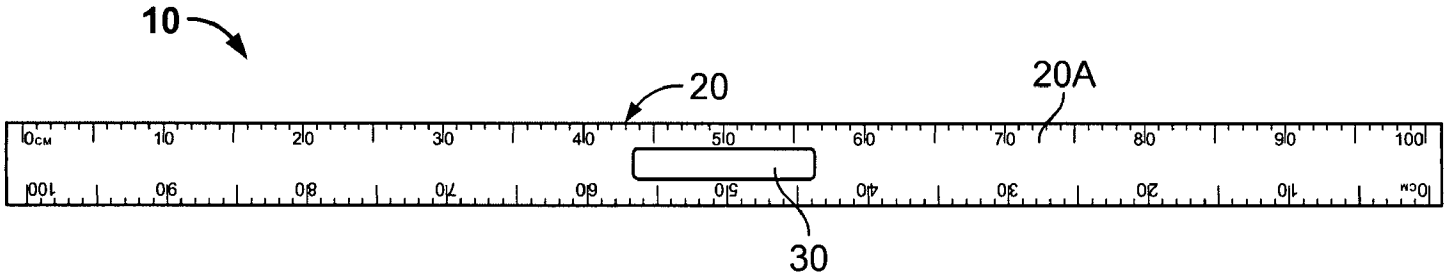
FIG. 1 is a top plan view of an embodiment of a folding ruler.

Referring now to the Figures, a folding ruler is described. As shown in FIG. 1, one embodiment of the folding ruler 10 is illustrated as a meter stick, but the folding ruler 10 may be a yard stick or other straightedge-type measuring device known in the art. As shown in FIG. 1, in its extended state the folding ruler 10 includes a generally planar, rectangular panel 20 (e.g., a strip or slat). As can be appreciated from the Figures and particularly FIGS. 1 and 2, the panel 20 may include two or more panel members (e.g., panel members 22, 24 in FIG. 2) that abut each other end to end and fold together. As shown in FIG. 1, when the panel members 22, 24 (FIGS. 2–4) are in their unfolded state, the panel 20 of ruler 10 has the appearance of a solid, one-piece member, and therefore, a breakpoint between the panel members 22, 24 is not illustrated. As can be further appreciated from FIGS. 1 and 2, the panel 20 has a top surface 20A with indicia thereon and a bottom surface 20B. The panel members 22, 24 may be made of wood, metal, plastic or other suitable material known in the art. In one embodiment, the panel members 22, 24 are formed or molded from plastic so that the ruler 10 is light, durable and relatively inexpensive to produce. The indicia may be printed, etched, stamped, formed or the like on the top surface 20A of the panel 20. Since the illustrated folding ruler 10 is a meter stick, the indicia on the panel 20 provides a metric scale from zero to 100 centimeters along the length of the panel 20. As shown, each lengthwise side includes a scale, but the panel 20 may include a scale along only one lengthwise side. Further, the indicia may provide a combination of scales such as, for example, a metric scale along one lengthwise side and an English unit scale (e.g., inches, feet, etc.) on the other lengthwise side. Moreover, one can appreciate that, in some embodiments, the bottom surface 20B may also have indicia thereon. For example, the grip 30, which is discussed hereafter in further detail, may be attached to both the top and bottom surfaces 20A, 20B so that the panel 20 is reversible, including the top surface 20A having a metric scale and the bottom surface 20B having an English unit scale (or vice versa).

Figure 2:
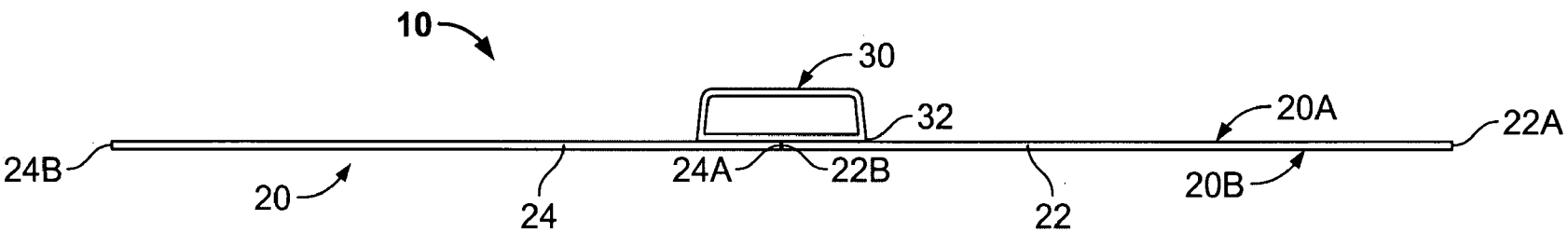
FIG. 2 is an elevation view of the embodiment of FIG. 1.
Figure 4:
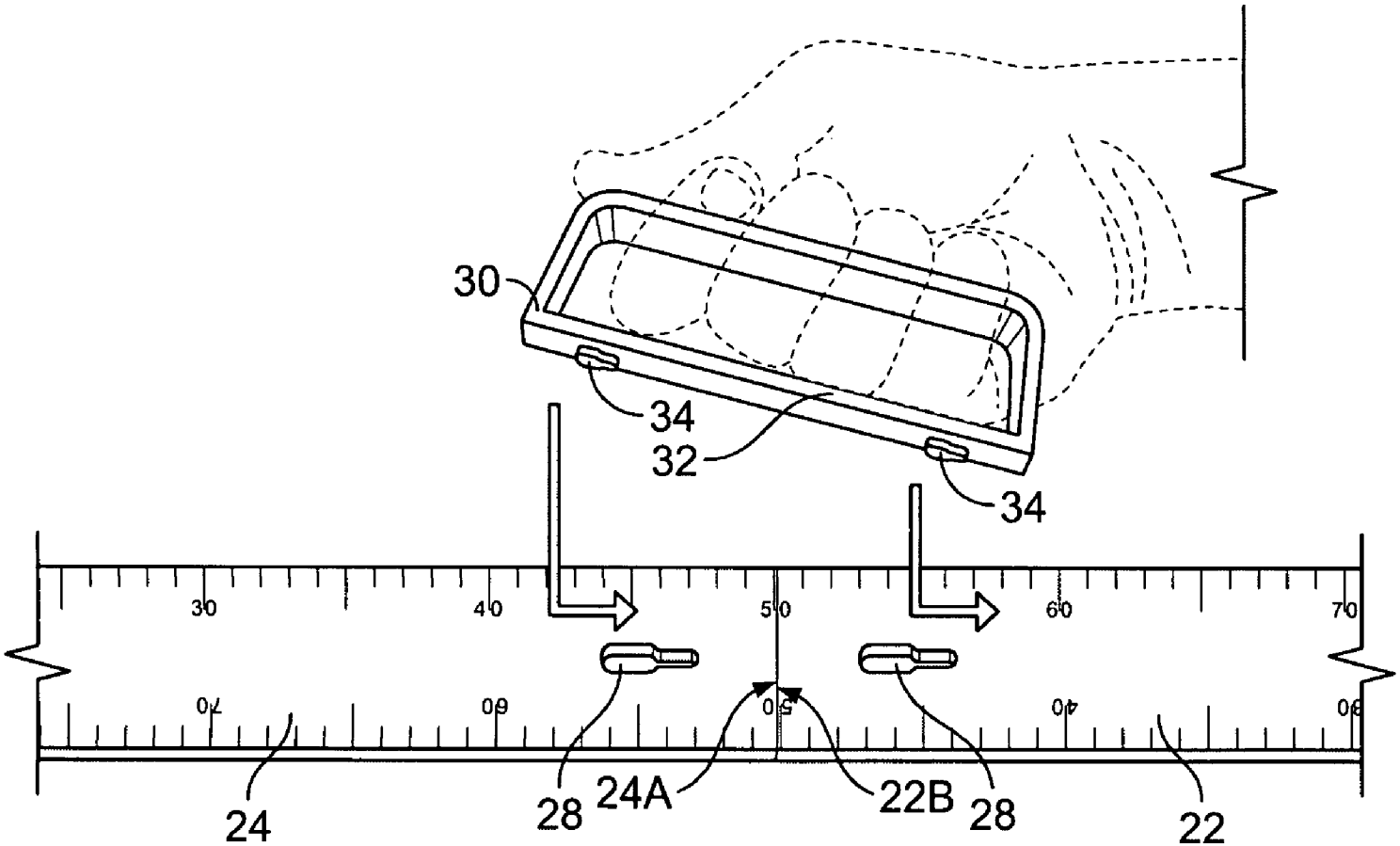

As shown in FIGS. 1 and 2, the folding ruler 10 includes a grip 30 on the top surface 20A of the panel 20 and extending upward therefrom. As shown, the grip 30 is substantially centered along the length of the panel 20 to balance the ruler 10 and facilitate handling thereof, but the grip 30 may be positioned elsewhere along the length of the panel. Particularly, the grip 30 helps a user handle the ruler 10 on a substantially vertical surface such as a wall, chalk/marker board or the like. As can be appreciated from FIGS. 1 and 2, one embodiment of the grip 30 is a handle, but the grip 30 may be a knob, strap or other rigid or semi-flexible member that is known in the art for holding and carrying an object. As shown in FIG. 2, the illustrated grip 30 is a generally D-shaped handle that is adapted to be held and gripped with the fingers of the hand, but the grip 30 may be shaped otherwise or may additionally include an ergonomic treatment known in the art for alleviating fatigue of the hand, wrist and arm. As best illustrated in FIGS. 2 and 4, the example grip 30 includes a base portion 32 that is generally planar and abuts the top surface 20A of the panel 20. As will be discussed hereafter in further detail, an embodiment of the grip 30 provides a means to stiffen the panel 20 when attached thereto.

Figure 3:
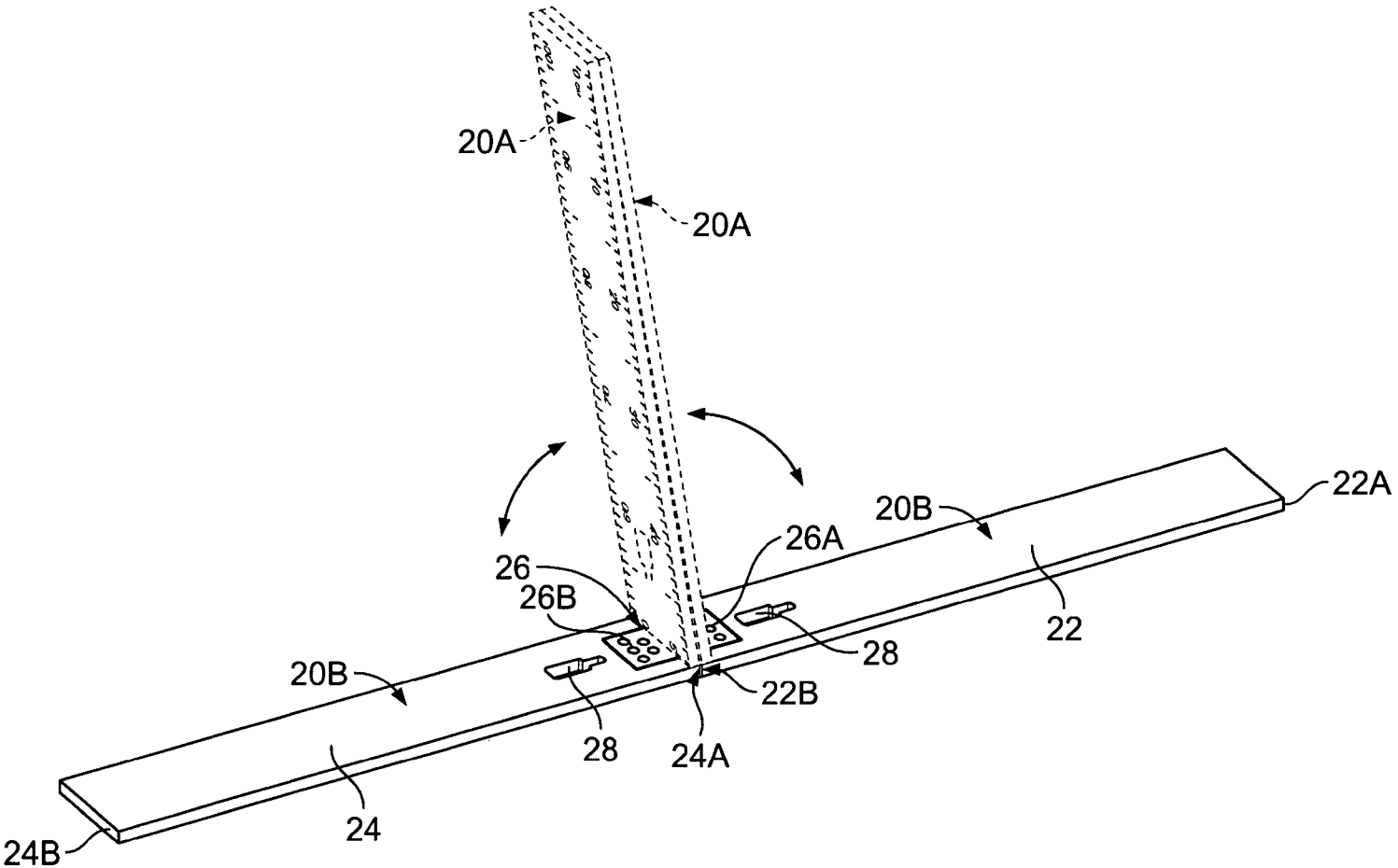
FIG. 3 is a rear perspective view of the embodiment of FIG. 1, also showing the ruler in an example folded state.

As shown in FIGS. 2–4, the example panel 20 includes a first panel member 22 and a second panel member 24, but may include more than two panel members. As can be appreciated from the illustrated embodiment, each panel member 22, 24 is half the length of the panel 20, but the lengths of the panel members 22, 24 may be different. As shown, the first panel member 22 has a generally rectangular and lengthwise body defined by parallel lengthwise edges, a first end including a first edge 22A that is generally perpendicular to the lengthwise edges and a second end including a second edge 22B that is also generally perpendicular to the lengthwise edges. As shown, the first planar member 22 is oriented so that the first edge 22A is the right edge, which is distal from the grip 30, and the second edge 22B is the left edge, which is proximal the grip 30, but the first planar member 22 may be oriented so the edges 22A, 22B are reversed. Similarly, the second panel member 24 has a generally rectangular and lengthwise body defined by parallel lengthwise edges, a first end including a first edge 24A that is generally perpendicular to the lengthwise edges and a second end including a second edge 24B that is also generally perpendicular to the lengthwise edges. As shown, the second planar member 24 is oriented so that the first edge 24A is the right edge, which is proximal the grip 30, and the second edge 24B is the left edge, which is distal from the grip 30, but the second planar member 24 may be oriented so the edges 24A, 24B are reversed. Although the example planar members 22, 24 are illustrated as having rectangular shapes, the planar member 22, 24 could be shaped otherwise, for example, as trapezoids, parallelograms, squares and other polygonal shapes.

As illustrated, the first and second panel members 22, 24 are oriented end to end so that a first edge 22B of panel member 22 and a second edge 24A of panel member 24 are in close proximity to each other, for example, substantially abutting each other, to give the appearance that the panel 20 is a solid, one-piece member and that the indicia (i.e., scales) on the top surface 20A is continuous. As can be appreciated from FIGS. 1 and 2, the example panel members 22, 24 are substantially similar to each other, being substantially the same size and shape. Further, with reference to FIG. 1, the top surface 20A of example panel member 22 has substantially similar indicia as example panel member 24. That is, as best illustrated in FIGS. 1 and 4, each panel member 22, 24 includes a top surface 20A having a first scale from zero centimeters to fifty centimeters (e.g., without the digit zero of 50) on one lengthwise side and a second scale from one hundred centimeters to fifty centimeters (e.g., without the digit five of 50) on the other lengthwise side. Now, one can appreciate that the illustrated panel member 22, 24 can be oriented to provide a continuous scale from zero to one hundred centimeters along each lengthwise side, for example as shown in FIG. 1.

Referring now to FIG. 3, the bottom surface 20B of the example panel 20 that includes panel members 22, 24 is illustrated. Although the bottom surface 20B is illustrated as not including indicia, the folding ruler 10 is not limited as such. As shown, the panel members 22, 24 of the illustrated embodiment are coupled together at their respective ends 22B, 24A by a hinge 26. In other embodiments, the panel members 22, 24 of panel 20 may be coupled together at their respective ends 22B, 24A by an alternative coupling known in the art such as a strap, cable, wire, rope, spring or the like so the panel members 22, 24 do not become separated from each other. However, in further embodiments, the panel members 22, 24 of panel 20 may not be coupled together at all. As shown in FIG. 3, the hinge 26 includes a first leaf 26A and a second leaf 26B that are substantially coplanar with the bottom surface 20B when the ruler 10 is unfolded/extended. The hinge 26 may be a hinge that allows continuous movement (i.e., 360° rotation) of each leaf 26A, 26B, or the hinge 26 may be a hinge that includes a bias that allows each leaf 26A, 26B to move only in a certain direction and/or through a predetermined angle such as, for example, 90° or 180°. As shown, the first leaf 26A of hinge 26 is affixed to a left end (e.g., edge 22B) of panel member 22 and the second leaf 26B of hinge 26 is affixed to a right end (e.g., edge 24A) of panel member 24. In embodiments of the ruler 10 including more than two panel members, additional hinges, couplings or the like may be provided as necessary to couple all of the panel members together, thereby forming a panel 20 that is articulated in more than one location along its length.

As can be appreciated, the hinge 26 may be any suitable hinge known in the art such as butt hinge, butterfly hinge, continuous hinge, piano hinge, mortise hinge or the like. Further the hinge 26 may be affixed to the panel members 22, 24 by any suitable mechanical means known in the art such as fasteners, friction fit, interference fit, adhesive bonding and the like. In the illustrated embodiment, the left end of planar member 22 and the right end of planar member 24 each includes a recess, cavity, mortise or the like that is adapted to receive one leaf 26A, 26B of the hinge 26 so that the bottom surface 20B is substantially flat. In other embodiments, the hinge 26 may be unitary, integrally formed or otherwise molded with the panel members 22, 24 to provide a hinge 26 that is known in the art as a living hinge.

As illustrated in FIG. 3, the hinge 26 allows relative movement of the panel members 22, 24 between a folded, compact state (shown in dashed lines) wherein the panel members 22, 24 are generally parallel and overlapping, and an unfolded, extended state wherein the panel members 22, 24 are coplanar and end to end. As shown, the example hinge 26 allows the panel members 22, 24 to fold together such that the panel members 22, 24 are oriented back surface 20B of panel member 22 to the back surface 20B of panel member 24, but the hinge 26 may alternatively or additionally allow the panel members 22, 24 to fold such that the panel members 22, 24 are oriented top surface 20A of panel member 22 to top surface 20A of panel member 24. As can be appreciated, the folded, compact state may be used for storing and transporting the ruler 10, whereas the ruler 10 may be used in the unfolded, extended state for measuring and drawing lines.

As further shown in FIG. 3, each panel member 22, 24 includes a keyhole slot 28. Each keyhole slot 28 is disposed at an end of each panel member, and more particularly, one keyhole slot 28, which is disposed at the left end of planar member 22, is proximate another keyhole slot 28, which is disposed at the right end of planar member 24. As shown, the keyhole slots 28 are similarly oriented and positioned on either side of the hinge 26, each keyhole slot 28 being spaced away from the hinge 26 by a predetermined distance. As can be appreciated from FIGS. 1 and 2, the keyhole slots 28 are equally spaced away from the hinge 26 so that the grip 30 is generally centered along the length of the panel 20 and over the hinge 26.

Referring now to FIG. 4, one can appreciate that the keyhole slots 22 facilitate coupling of the grip 30 with each of the panel members 22, 24. As shown in FIG. 4, the example grip 30, which is illustrated as a generally D-shaped handle, includes a generally planar base portion 32 with two spaced-apart projections 34. The projections 34 are spaced apart to couple with the keyhole slots 28 so that the base portion 32 abuts the top surface 20A as best shown in FIGS. 1 and 2. The projections 34, which extend away from the outer surface of the base portion 32, are adapted to fit in the keyhole slots 28. As can be appreciated from FIG. 2, the projections 34 do not surpass the bottom surface 20A when the grip 30 is coupled with the panel members 22, 24.

Figure 5:
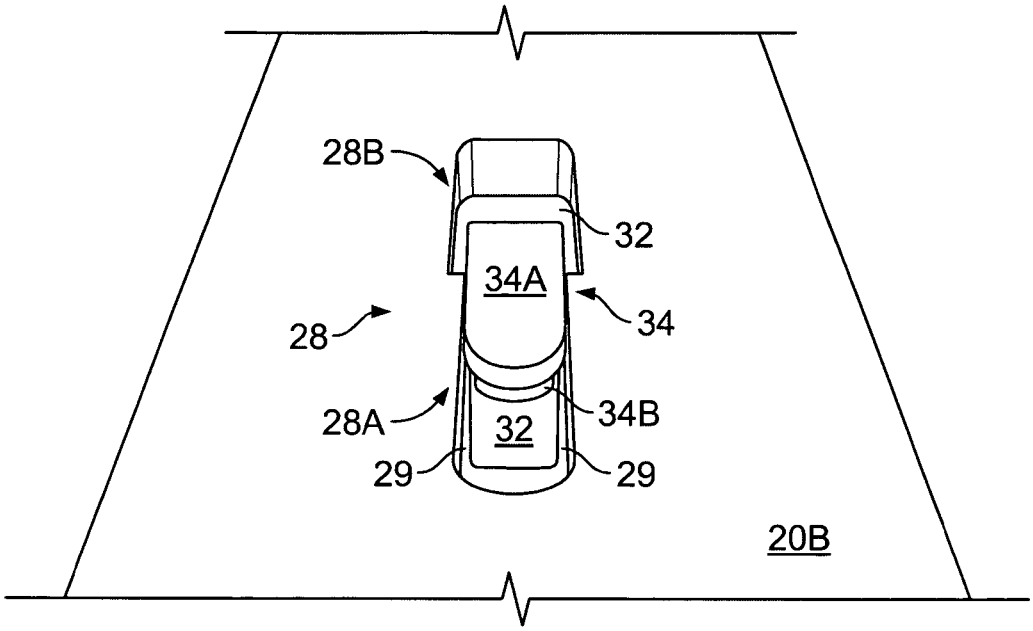
FIG. 5 is a partial perspective view of FIG. 3 illustrating one keyhole slot of the embodiment.

As shown in FIG. 5, the example keyhole slot 28 includes a wide section 28B, a narrow section 28A and a retaining member 29. The example retaining member 29 is formed as a shelf, ledge, web or the like along a portion of the keyhole slot 28, particularly along the lengthwise sides of the narrow section 28A. The example retaining member 29 is generally parallel with the bottom surface 20B and has a thickness for positively engaging the projection 34. As can be appreciated from FIG. 5, the example projection 34 is a generally T-shaped member when viewed in an end-on elevation view including a horizontal fin 34A and a vertical base 34B that attaches the fin 34A to the outer surface of the base portion 32. As can be appreciated, the distance between the inner surface of the fin 34A and the outer surface of the base portion 32 is substantially the same as the thickness of the retaining member 29 to provide a frictional mating of the projection 34 in the keyhole slot 28 thereby preventing accidental disengagement of the grip 30 from the panel 20.

Now, after the panel members 22, 24 of panel 20 are unfolded about hinge 26 or otherwise arranged in the coplanar, end to end, close proximity orientation, the grip 30 is coupled to the panel 20. As illustrated by the L-shaped arrows in FIG. 4, the grip 30 is first positioned so that projections 34 are aligned with the keyhole slots 28. Next, the grip 30 is pressed onto the top surface 20A of the panel members 22, 24 so that the fins 34A are inserted in the wide portions 28B of keyhole slots 28. As the grip 30 is pressed down onto the top surface 20A, the fins 34A pass below the retaining members 29, thereby aligning each retaining member 29 with the gap between the fin 34A and the planar outer surface of base portion 32. Finally, the grip 30 and or the panel members 22, 24 are moved linearly so that the fins 34A of projections 34 slidably advance in the keyhole slots 28 from the wide portions 28B to the narrow portions 28A. The fins 34A continue to advance forward in the narrow portions 28A and come to rest with the retaining members 29 sandwiched firmly between the fins 34A and the base portion 32, thereby frictionally mating the grip 30 to the panel 20. Thus coupled, the bottom surface of the base portion 32 abuts the top surface 20A of the panel 20 and traverses the hinge 26 thereby operating to stiffen the panel 20 by locking the panel members 22, 24 in the unfolded state.

Indeed, if the panel 20 included more than two panel members and more than one hinge, the grip 30 could be suitably adapted (e.g., with respect to size, shape and number of projections) to prevent movement of the panel members about the hinges. In one embodiment wherein the panel 20 includes three panel members (i.e., left, right and center panel members) that are interconnected by two hinges (i.e., a first hinge connecting the left and center panel members and a second hinge connecting the right and center panel members), a grip 30 would include a base portion 32 that is sufficiently long to traverse both hinges and the base portion 32 may include, for example, four projections for mating with a keyhole slots positioned at each end of the center panel, a keyhole slot positioned at the left end of the right panel member and a keyhole slot positioned at the right end of the left panel member. Although the illustrated embodiment includes keyhole slots 28 and projections 34 for coupling the grip 30 with the panel 20, other embodiments may include additional or alternative coupling means. For example, in some embodiments the grip 30 may include a clamp for facilitating releasable attachment with the panel 20. In other embodiments, the grip 30 may be coupled with the panel 20 by a removable fastener such as a screw, nut and bolt and the like known in the art.

Of course the foregoing described assembly steps may be performed in reverse to remove the grip 30 from the panel 20 and fold the ruler 10. When the grip 30 is uncoupled and removed from the panel 20, the ruler 10 may then be folded. Further, the grip 30 may be stored with the folded panel 20 by coupling the grip 30 to one of the keyhole slots 28 thereby preventing the grip 30 from becoming lost or misplaced. To this end, one or both of the panel members 22, 24 may include a clearance hole (not shown) for the other projection 34 that is not engaged in the keyhole slot 28. Such a clearance hole may be spaced away from the keyhole slot 28 so that the base portion 32 lies substantially flat against the single panel member and undue mechanical stress is not placed on the grip 30 (i.e., the fin 34A of the projection 34) and/or the panel member itself. Further, one or both of the panel members 22, 24 may include an aperture (not shown) for hanging the ruler 10 on a fastener such as a hook, nail, screw or the like. Additionally, the panel members 22, 24 may include a means for preventing the panel members 22, 24 from unfolding when being stored or transported. Such a means may be embodied by a hook and loop closure, a latch and/or catch such as a hook and eye, and the like.

While the invention has been illustrated and described in detail in the drawings and foregoing description, these are to be considered as illustrative and not restrictive in character.

While the present invention has been illustrated by a description of various embodiments and while these embodiments have been set forth in considerable detail, it is intended that the scope of the invention be defined by the appended claims. It will be appreciated by those skilled in the art that modifications to the foregoing embodiments may be made without departing from the teachings of the present invention. It is deemed that the spirit and scope of the invention encompass such variations as would be apparent to one of ordinary skill in the art and familiar with the teachings of the present application.

What is claimed is:

1. A ruler comprising:

a first panel including a top surface having a first scale thereon;

a second panel including a top surface having a second scale thereon; and a generally D-shaped handle that removably couples with the first and second panels for locking said first and second panels in a first state wherein said first and second panels are coplanar and oriented end to end.

2. A ruler in accordance with claim 1 wherein the first panel is substantially similar to the second panel.

3. A ruler in accordance with claim 1 wherein the first and second scales provide a continuous scale when the ruler is in the first state.

4. A ruler in accordance with claim 1 further comprising a hinge that connects an end of the first panel to an end of the second panel for movement of the first and second panels between the first state and a folded state wherein said first and second panels are generally overlapping and parallel to each other.

5. A ruler in accordance with claim 4 wherein the hinge comprises a living hinge that is unitarily molded with the first and second panels.

6. A ruler in accordance with claim 1 wherein the ends of said first and second panels that are adjacent each other when said first and second panels are in the first state each comprise a keyhole slot and wherein the generally D-shaped handle comprises a base portion and two spaced-apart projections extending away from the base portion for mating with the keyhole slot of said first and second panels.

7. A ruler in accordance with claim 6 wherein the base portion comprises a generally planar bottom surface that abuts the top surfaces of the first and second panels.

8. A ruler comprising:

a first rectangular panel that includes a right end having a first keyhole slot that is spaced away from a right edge and a top surface having first indicia thereon;

a second rectangular panel that includes a left end having a second keyhole slot that is spaced away from a left edge and a top surface having second indicia printed thereon;

a hinge that couples the right edge of the first rectangular panel and the left edge of the second rectangular panel such that the first and second rectangular panels are movable between an extended configuration wherein said first and second rectangular panels are coplanar and a folded configuration wherein said first and second rectangular panels are substantially overlapping and oriented to be one of top surface to top surface and bottom surface to bottom surface; and a removable stiffening member that traverses the hinge to lock the first and second panels in the extended configuration, the removable stiffening member including two spaced-apart panel-engaging members for insertion into and slidable friction engagement with said first and second keyhole slots.

9. The ruler of claim 8 wherein the hinge comprises a living hinge.

10. The ruler of claim 8 wherein the first and second indicia comprise at least one graduated scale.

11. The ruler of claim 8 wherein the removable stiffening member comprises a grip for handling the ruler.

12. The ruler of claim 11 wherein the grip comprises a generally D-shaped handle.

13. A ruler comprising:

a first panel including a first aperture and a top surface bearing a first scale thereon;

a second panel including a second aperture and a top surface bearing a second scale thereon; and a grip that removably couples with the first and second apertures to lock the first and second panels in a first state wherein the first and second panels are coplanar and oriented end to end.

14. A ruler in accordance with claim 13 wherein the first panel is substantially similar to the second panel.

15. A ruler in accordance with claim 13 wherein the first and second scales provide a substantially continuous scale when the ruler is in the first state.

16. A ruler in accordance with claim 13 further comprising a hinge that connects an end of the first panel to an end of the second panel for movement of the first and second panels between the first state and a folded state wherein said first and second panels are generally overlapping and parallel to each other.

17. A ruler in accordance with claim 16 wherein the hinge comprises a living hinge that is unitarily molded with the first and second panels.

18. A ruler in accordance with claim 13 wherein the grip is a handle, the handle including a base portion with two spaced-apart panel-engaging members configured for insertion into the first and second apertures.

19. A ruler in accordance with claim 18 wherein the base portion comprises a generally planar bottom surface from which the two spaced-apart panel-engaging members extend, the generally planar bottom surface configured to abut the top surfaces of the first and second panels when said first and second panels are in the first state.

* * * * *